United States Patent [19]

Young

[11] Patent Number: 4,749,474

[45] Date of Patent: Jun. 7, 1988

[54] SCREENING APPARATUS

[75] Inventor: Douglas L. G. Young, Nashua, N.H.

[73] Assignee: Ingersoll-Rand Company, Woodcliff Lake, N.J.

[21] Appl. No.: 900,714

[22] Filed: Aug. 27, 1986

[51] Int. Cl.[4] ..... B07B 1/04

[52] U.S. Cl. ..... 209/273; 162/55; 209/306; 210/415

[58] Field of Search ..... 209/305, 306, 268, 273, 209/270, 250, 300, 379; 162/55, 57, 251, 384, 274; 210/413–415

[56] References Cited

U.S. PATENT DOCUMENTS

| | | | |
|---|---|---|---|
| 3,245,535 | 4/1966 | Cowan | 209/273 |
| 3,586,172 | 6/1971 | Young | 209/273 |
| 4,111,373 | 9/1978 | Holz | 209/273 |
| 4,287,055 | 9/1981 | Holz | 209/306 |
| 4,634,521 | 1/1987 | Simola et al. | 209/306 |
| 5,363,759 | 1/1968 | Clarke-Pounder | 209/306 |

*Primary Examiner*—Johnny D. Cherry
*Assistant Examiner*—Donald T. Hajec
*Attorney, Agent, or Firm*—Frank S. Troidl

[57] ABSTRACT

A screen and a coaxially radially spaced rotor provide a fluid passage for the fibrous material—liquid suspension. The rotor surface has the effect of pumping or assisting a flow of dilution liquid from the reject end towards the inlet end of the fluid passage, thereby partly or wholly offsetting the natural thickening of the suspension during screening.

3 Claims, 3 Drawing Sheets

SCREENING APPARATUS

This invention relates to the screening of suspensions comprising mixtures of fibrous material and liquid. More particularly, this invention relates to the separation of a fibrous material—liquid suspension, such as wood pulp into an accepts portion and a rejects portion.

Currently manufactured screening apparatus include the screening apparatuses illustrated in U.S. Pat. No. 3,363,759 issued Jan. 16, 1968 to I. J. Clarke-Pounder and entitled "Screening Apparatus with Rotary Pulsing Member", U.S. Pat. No. 3,437,204 issued Apr. 8, 1969 to I. J. H. Clarke-Pounder and entitled "Screening Apparatus" and U.S. Pat. No. 3,586,172 issued June 22, 1971 to Douglas L. G. Young and entitled "Screening Apparatus".

With a typical screening apparatus such as a screening apparatus for pulp, the pulp enters the housing and flows through an annular fluid passage between the rotor and the screen. The accepts (and liquid) flows through perforations or slots in the screen. The rejects proceed through the fluid passage and ultimately are discharged through the rejects outlet. The rejects include unacceptable material such as shives, slivers, and other foreign material in the pulp. The screening apparatus may also be used to fractionate the pulp suspension, that is, divide the pulp suspension into two outgoing streams, one having predominately the coarse, or long fiber fraction, the other having predominately the short fiber fraction.

The natural effect of the flow distribution and fractionation is for thickening to take place in the fluid passage between the rotor and the screen. The consistency of the pump slurry increases progressively from the inlet end of the fluid passage to the outlet end of the fluid passage. Without dilution, the ratio of consistency at the outlet end to the consistency at the inlet end might approach 5:1.

The effects of this high consistency include decreased screening efficiency and high overrun of good fiber in the rejects stream. The decreased screening efficiency is a direct result of the higher consistency and the longer residence time of the fibrous material that occurs with higher consistency.

Adding dilution liquid to the fluid passage reduces the consistency of the suspension thereby permitting reduced good fiber overrun and controlling the uniformity of the consistency in the screening zone. It is highly desirable that the consistency remain relatively constant throughout the length of the fluid passage in the screening zone to optimize efficiency of screen performance. This invention is an improved and new screening apparatus which is constructed to promote uniform consistency throughout the length of the fluid passage, reduced residence time of the rejects, lower overrun of good fiber in the rejects stream, and improved screening efficiency.

Briefly described, this invention is an apparatus for screening a fibrous material—liquid suspension to separate the fibrous material into an accepts portion and a rejects portion. A screen has openings adapted to accept the accepts portion and reject the rejects portion. A rotor extends along the screen and is radially spaced therefrom by a fluid passage between the rotor and the screen. A suspension inlet communicates with the fluid passage for supplying the fibrous material—liquid suspension to the fluid passage. A rejects outlet is longitudinally spaced from the suspension inlet and communicates with the fluid passage for discharging the rejects portion rejected by the screen openings. An accepts outlet for discharging the accepts portion receives the accepts which have passed through the screen openings. The shape of the screen and the shape of the rotor is such that from a predetermined point downstream from where the fibrous material is supplied, the fluid passage is wider for predetermined distance toward the rejects outlet. A dilution inlet is in communication with the wider part of the fluid passage and is used to feed a dilution liquid into the wider part.

The screen may be a cylindrical screen. The outside surface of the rotor may be generally cylindrical from where the suspension is supplied to the fluid passage up to a predetermined point followed by a surface which tapers inwardly toward the axis of the rotor. The rotor instead of having the taper could be of another shape such as parabolic or one or more steps, or combinations thereof.

The invention as well as its many advantages may be further understood by reference to the following detailed description and drawings in which.

Figure 1:
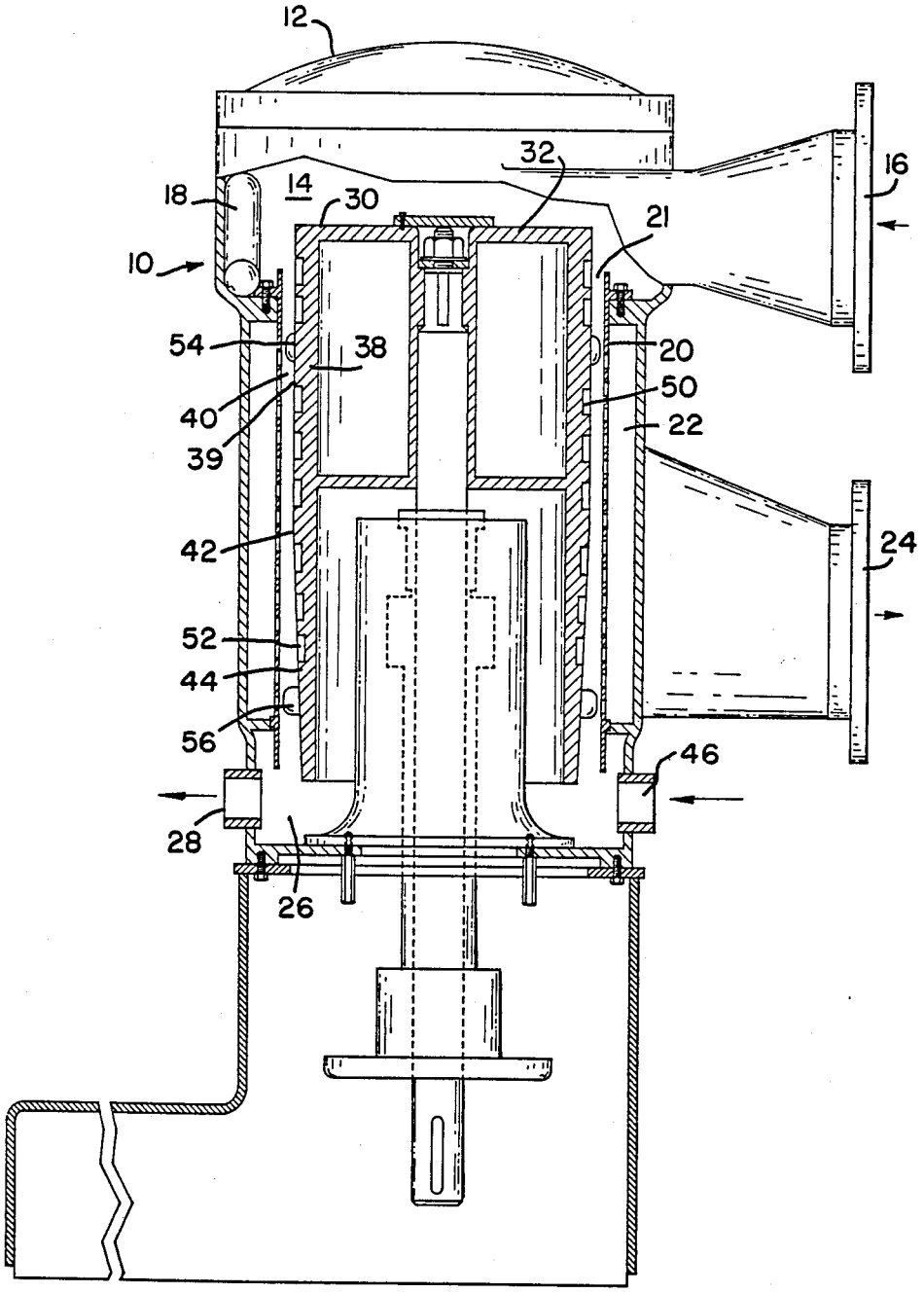
FIG. 1 is a side view, partly in cross-section, of the screening apparatus according to the invention.

Referring to the drawings and more particularly to FIG. 1, the screening apparatus includes a pressure housing 10 including a removable pressure dome 12. An inlet chamber 14 is provided in the upper region of the housing 10. A suspension inlet 16 is arranged to introduce a fibrous material—liquid suspension, such as wood pulp into the inlet chamber 14. A heavy material trap 18 communicates with the chamber 14 for removing material drawn to the periphery of the inlet chamber 14 by centrifugal force.

A fixed annular screen 20 having an open top 21 is in fluid communication with the suspension inlet 16 through the inlet chamber 14. The walls of the annular screen 20 are spaced radially inwardly from the casing 10 to provide an annular accepts chamber 22 outside of the annular screen 20. A tangential accepts outlet 24 is adapted to remove fluid under substantial pressure. If desired, accepts outlet 24 may be radial. Accepts outlet 24 is connected to the accepts chamber 22.

The fixed screen 20 may be of the usual form for fine screening, that is, it can have circular holes or may be of the slotted type.

Below the annular screen 20 is arranged an annular rejects chamber 26 in communication with the inside of the annular screen member 20. A rejects outlet 28 communicates with the rejects chamber 26 for removal of the rejects out of the housing 10. A rotor 30 having a closed top 32 and an open bottom 34 is coaxially mounted within the annular screen 20. In the embodiment shown in FIG. 1, the rotor 30 is slightly longer than the annular screen 20 with both the top portion and the bottom portion of the rotor 30 extending slightly above and below, respectively, the top and bottom respectively of the screen 20.

The peripheral outside surface of the rotor annular wall 38 is inwardly spaced from the screen 20 to provide an annular fluid passage 40.

The top portion of rotor 30 is cylindrical. The outside surface 39 is concentric to the screen 20. Thus, the width of the fluid passage 40 from the top 32 of the screen 20 up to the predetermined point 42 is constant. The width of the fluid passage up to point 42 need not necessarily be constant. For example, the fluid passage may converge toward point 42.

Tapering outside surface 44 extends from the predetermined point 42 to the bottom of the rotor 30. The tapering surface 44 tapers radially inwardly from the point 42 to the rotor bottom. Thus, the width of the annular fluid passage 40 continuously increases from the predetermined point 42 to the screen 20 bottom.

A dilution liquid inlet 46 is provided on the housing 10. The dilution liquid inlet 46 is longitudinally located below the bottom of the annular fluid passage 40 and is in communication with said passage through the rejects chamber 26.

Figure 3:
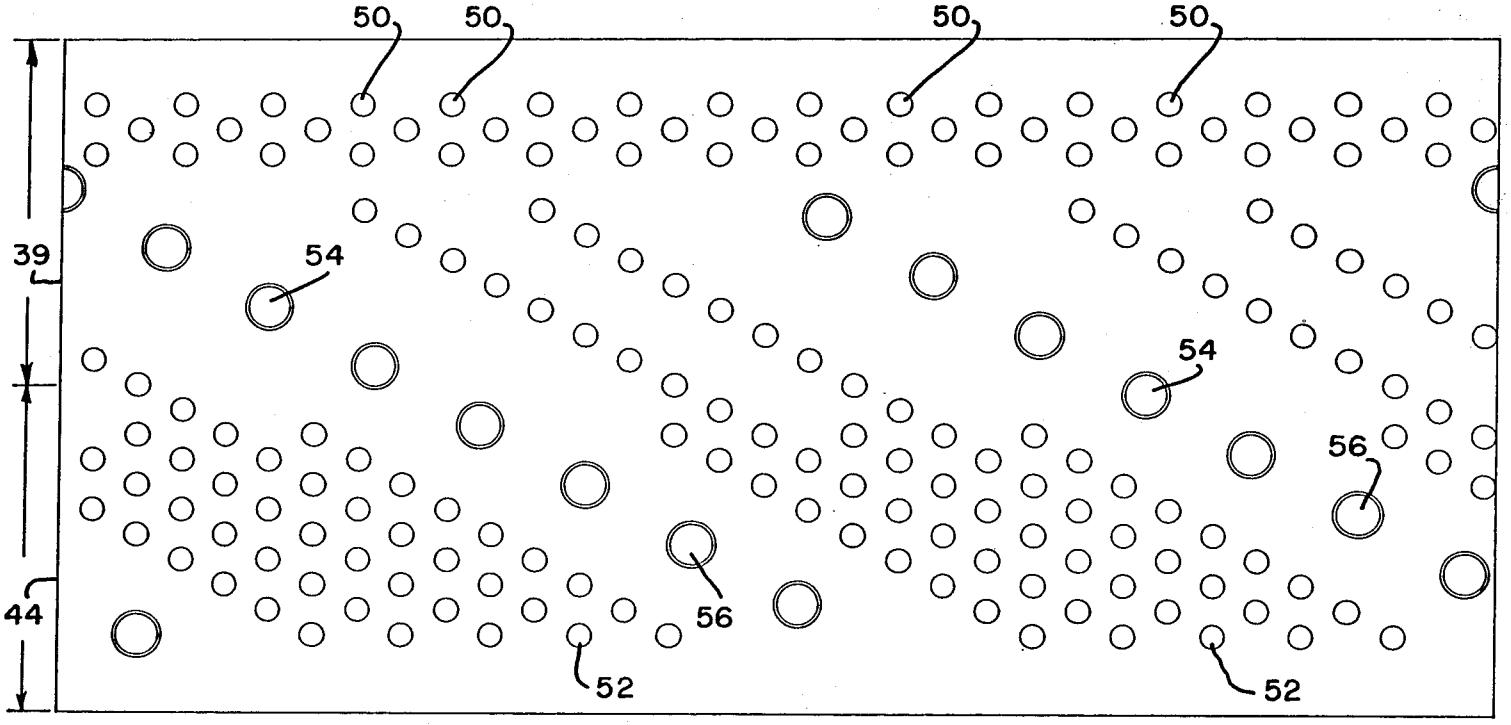
FIG. 3 is a drawing illustrating the surface configuration of the rotor outside surface. In the various figures, like parts are referred to by like numbers.

Referring to FIG. 1 and FIG. 3, the rotor outside surfaces are provided with a series of bumps and a series of depressions. The depressions 50 along the outside cylindrical surface 39 and the depressions 52 along the tapered outside surface 44 are all approximately the same depth.

The bumps 54 extending radially outwardly from the outside cylindrical surface 39 are the same height, with the peaks of the bumps being the same distance from the screen 20.

The function of the depressions 50 and 52 is to accelerate the pump tangentially to provide and maintain tangential velocity and to defloculate the pump so that the fibers act independently.

The function of the bumps 54 is to generate the high amplitude negative flow surge that prevents the screen apertures from blinding or plugging. In order to generate a sufficiently high amplitude negative flow surge to prevent plugging, it is necessary that the peaks of the bumps be sufficiently close to the inside surface of the screen 20 to provide the high amplitude negative flow surge without the bumps contacting the inside of the screen. Therefore, the bumps 56 extending radially outwardly from the tapered surface 44 are radially larger than the bumps 54 on the outside cylindrical surface 39. This is so that the peaks of the bumps 56 will be very close to the inside of the screen 20. The separation of the peaks of the bumps 56 from the screen is approximately the same as the separation of the peaks of the bumps 54 from the screen.

Figure 2:
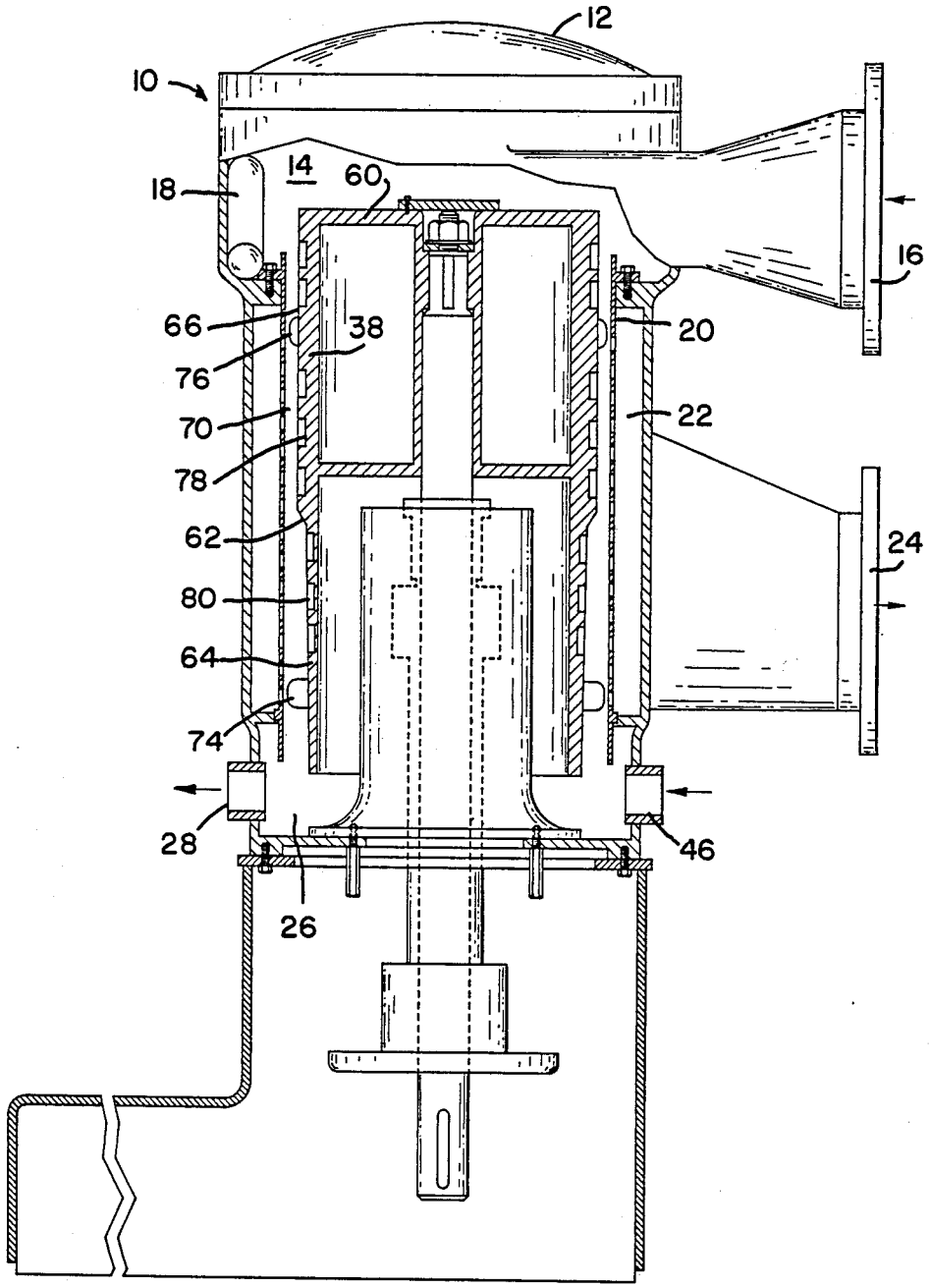
FIG. 2 is a side view, partly in cross-section, of a further embodiment showing an alternative rotor structure.

In the embodiment shown in FIG. 2, the rotor 60 has a shoulder formed by downwardly tapering annular surface 62 interconnecting the downwardly tapering outer surface 64 of the rotor and the outer surface 66. The width of channel 70 is constant from the suspension inlet to shoulder 62; the width of channel 70 below shoulder 62 increases from shoulder 62 to the bottom of the screen.

The bumps 74 mounted on the tapering surface 64 of the rotor 60 and the bumps 76 mounted on the larger diameter section of the rotor are each dimensioned so that the peaks of all the bumps on the rotor are spaced from the inside of the annular screen by the same amount. The depressions 78 in outside wall 66 and the depressions 80 in outside wall 64 are all approximately the same depth.

In operation and looking at FIG. 1, the suspension of a fibrous material in a liquid is fed through suspension inlet 16 and through the fluid passage 40 to the rejects outlet 28. The accepts pass through the apertures in the screen 20 and out the accepts outlet 24. The rejects flow completely through the fluid passage 40, rejects chamber 26 and out the rejects outlet 28.

A dilution liquid is fed through dilution inlet 46 rejects chamber 26, and generally flows into the wider portion of the fluid passage 40. The effect of this dilution liquid decreases the consistency of the suspension in the lower part of the fluid passage 40 and carries fiber up into the fluid passage. The dilution effect is chosen so that the change in consistency throughout the entire length of the fluid passage 40 will be minimized. The tapered rotor surface has the effect of pumping or assisting the flow of dilution liquid from the rejects end towards the inlet end of the fluid passage 40, thereby partly or wholly offsetting the natural thickening of the suspension during screening.

It is important that the dilution liquid mix with the suspension in the fluid passage 40 and not go immediately and directly through the apertures in the screen 20. The point 42 on the rotor 30 is carefully chosen so that the dilution liquid will have a portion which runs tangential to the surface 44 of the rotor with a generally countercurrent direction to the downwardly axial direction of the suspension thus enhancing the mixing of the dilution liquid with the suspension.

The operation of the embodiment of FIG. 2 is similar to the operation of the embodiment of FIG. 1. The dilution liquid through dilution inlet 46 is fed into the wider portion of the fluid passage 70 and mixed with the incoming suspension from the top part of the fluid passage 70 to control the natural change in consistency of the suspension throughout the length of the passageway 70.

I claim:

1. An apparatus for screening a fibrous material—liquid suspension to separate the fibrous material into an accepts portion and a rejects portion, comprising:

a housing having a suspension inlet, a rejects outlet below the suspension inlet, and an accepts outlet between the suspension inlet and the rejects outlet; an annular screen having an open top communicating with the suspension inlet and an open bottom communicating with the rejects outlet, said screen having perforations through which accepts pass, the perforations communicating with the accepts outlet;

a rotor having a closed top and an open bottom coaxially mounted within the screen, the rotor being at least as long as the screen and radially spaced from the screen to provide an annular fluid passage, the rotor radially outside surface being cylindrical and having the same diameter from its closed top to a predetermined longitudinal point, said radially outside surface tapering radially inwardly from said predetermined longitudinal point to the rotor open bottom so that the annular fluid passage width continuously increases from said predetermined longitudinal point to the screen bottom;

and a dilution liquid inlet on the housing located below the bottom of the annular fluid passage and in communication with said annular fluid passage whereby dilution liquid is fed into the bottom of said annular fluid passage and upwardly into the continuously increasing width portion of said annular fluid passage to promote uniform consistency throughout the length of the annular fluid passage.

2. An apparatus for screening a fibrous material—liquid suspension to separate the fibrous material into an accepts portion and a rejects portion, comprising:

a housing having a suspension inlet, a rejects outlet below the suspension inlet, and an accepts outlet between the suspension inlet and the rejects outlet; an annular screen having an open top communicating with the suspension inlet and an open bottom communicating with the rejects outlet, said screen having perforations through which accepts pass, the perforations communicating with the accepts outlet;

a rotor coaxially mounted within the screen, the rotor being radially spaced from the screen to provide an annular fluid passage, the rotor radially outside surface tapering radially inwardly from a predetermined longitudinal point to the rotor bottom so that the annular fluid passage width continuously increases from said predetermined longitudinal point to the rotor bottom, said predetermined longitudinal point being located below the top of said rotor;

and a dilution liquid inlet on the housing located below the bottom of the annular fluid passage and in communication with said annular fluid passage whereby dilution liquid is fed into the bottom of said annular fluid passage and upwardly into the continuously increasing width portion of said annular fluid passage to promote uniform consistency throughout the length of the annular fluid passage.

3. An apparatus for screening a fibrous material - liquid suspension to separate the fibrous material into an accepts portion and a rejects portion in accordance with claim 2, wherein:

at said predetermined longitudinal point, the rotor has a shoulder formed by a downwardly tapering outer surface and the rotor outer surface tapers downwardly from the shoulder to the end of the rotor.

* * * * *